United States Patent [19]

Marxer

[11] Patent Number: 4,796,337

[45] Date of Patent: Jan. 10, 1989

[54] DEVICE FOR CLOSING A BOOT

[75] Inventor: Herbert Marxer, Schaan, Liechtenstein

[73] Assignee: Lange International, SA, Switzerland

[21] Appl. No.: 17,928

[22] Filed: Feb. 24, 1987

[30] Foreign Application Priority Data

Apr. 25, 1986 [CH] Switzerland ..... 1703/86

[51] Int. Cl.[4] ..... A43C 11/00

[52] U.S. Cl. ..... 24/68 SK; 24/70 SK; 24/71 SK

[58] Field of Search ..... 24/71 SK, 71 J, 70 SK, 24/70 J, 70 R, 71 T, 69 SK, 69 J, 68 SK, 68 J, 586, 686; 280/633; 36/50

[56] References Cited

U.S. PATENT DOCUMENTS

| | | | |
|---|---|---|---|
| 3,975,838 | 8/1976 | Martin | 24/71 SK X |
| 4,229,862 | 10/1980 | Kubelka | 24/68 SK |
| 4,326,320 | 4/1982 | Riedel | 24/70 SK |
| 4,395,801 | 8/1983 | Gabrielli | 24/71 SK X |
| 4,446,604 | 5/1984 | Sen-Yi | 24/71 J X |
| 4,453,290 | 6/1984 | Riedel | 24/70 SK |
| 4,546,521 | 10/1985 | Ribarits | 24/70 SK |
| 4,674,156 | 6/1987 | Olivieri | 24/71 SK |

FOREIGN PATENT DOCUMENTS

| | | | |
|---|---|---|---|
| 2629287 | 1/1977 | Fed. Rep. of Germany | 24/70 SK |
| 2844090 | 4/1979 | Fed. Rep. of Germany | 24/71 SK |
| 595070 | 1/1978 | Switzerland | 24/68 SK |

*Primary Examiner*—Peter A. Aschenbrenner
*Assistant Examiner*—James R. Brittain
*Attorney, Agent, or Firm*—Kane, Dalsimer, Sullivan, Kurucz, Levy, Eisele and Richard

[57] ABSTRACT

The device comprises a toothed strap with saw teeth (4), which is fixed, at one of its ends, to the boot (1) and carries a sliding U-piece (7) on which a ratchet (8) cooperating with the toothed strap is pivotably mounted. Above these teeth (10), the ratchet has a groove (11) inside which the bar (11) of a buckle (14) integral with another part of the boot is engaged. The U-piece is provided with two hook-shaped recesses located opposite the groove (11). The hinging pin (15) of the buckle, which at the same time acts as a tensioning lever, engages inside a groove (13). The ratchet pin is subject to a small degree of strain and accidental opening of the buckle due to pressure on the end of the latter is prevented.

2 Claims, 2 Drawing Sheets

DEVICE FOR CLOSING A BOOT

FIELD OF THE INVENTION

The present invention relates to a device for closing two parts of a boot, comprising a toothed strap intended to be fixed to one of the parts of the boot, fastening means which are mounted so as to slide on and around the toothed strap and are provided with a locking device cooperating with the toothed strap in a selected position, and a rectangular buckle which is integral with a tensioning lever and is intended to be fixed to the other part of the boot and which hooks onto the said fastening means.

PRIOR ART

CH-A-No. 638,085 describes such a device which comprises a toothed strap on its bottom surface and onto which the fastening means, comprising a U-piece provided with two lugs and a fastening member hinged with this U-piece, are fixed by means of clamping and engagement of the two lugs of the U-piece with the teeth of the strap. The buckle is of the conventional type hinged with a tensioning lever itself hinged with a U-piece fixed onto the other part of the boot. In order to adjust, therefore, the tension of this closing device, it is necessary to raise the fastening member so as to separate it from the strap. Such an operation requires a certain amount of force and cannot be performed very rapidly.

Moreover, it is widely known how to use a toothed strap with saw teeth as the connecting member, instead of a buckle, this toothed strap being inserted underneath a ratchet integral with the other part of the boot and the toothed strap being tensioned in the conventional manner by means of a tensioning lever. In such a device, all the pulling force on the toothed strap is absorbed by the pin of the ratchet which must therefore be correspondingly dimensioned.

It was also proposed, in CH-A-No. 406,901, to tension a cable by means of a tensioning lever mounted on a sliding block capable of being fixed on a rack by means of a ratchet. In this device, the tensioning force is also absorbed entirely by the pin of the ratchet.

SUMMARY OF THE INVENTION

The aim of the present invention to provide a closing device with a toothed strap of the type which can be rapidly adjusted, has a ratchet and is compact in shape and in which the ratchet pin is subject to a small degree of strain.

In the device according to the invention, the toothed strap has saw teeth, the device for locking the fastening member consists of a spring-loaded ratchet cooperating with the saw teeth and at the same time acting as the fastening member and having, for this purpose, a transverse groove with a hook-shaped profile located above the tip of the ratchet, and the buckle and its tensioning lever form a single piece intended to be hinged with the end of the other part of the boot, in its middle area, and being pressed down against the strap after being hooked onto the ratchets and tensioned.

Since the buckle is hooked onto the ratchet itself, just above its tip, the ratchet pin does not have to withstand the strong pulling force of the closing device, but only a force approximately perpendicular to the ratchet, resulting from the torque generated by the pulling force relative to the tip of the ratchet, this force acting on the ratchet pin being relatively very small. Thus, even if a ratchet pin with a small diameter is used, there is no risk of this pin breaking.

The part of the device integral with the other part of the boot is particularly simple, since it consists of a single part forming both the buckle and tensioner.

The device has the advantage, moreover, that the part of the boot carrying the buckle covers and hides the part of the toothed strap located between the fastening means and its free end, thereby preventing this free end of the toothed strap becoming separated from the boot and accidentally getting caught on a foreign object.

According to a preferred embodiment of the invention, the pawl support U-piece has two recesses forming an extension of the groove in the pawl and two notches inside which the hinging pin of the buckle is accommodated and positioned. The profile of the recesses is such that when the buckle is closed, i.e. pressed down on the fastening means, the buckle is locked, i.e. it is unable to escape from the pawl by pivoting about its middle pin inside the notches of the support piece. These notches ensure, moreover, that the buckle is aligned relative to the toothed strap and the pawl, thereby avoiding torsional stresses and unequal distribution of the pressure of the pawl tip on the tooth or teeth of the toothed strap.

BRIEF DESCRIPTION

The accompanying drawing shows, by way of an example, an embodiment of the invention.

Figure 3:
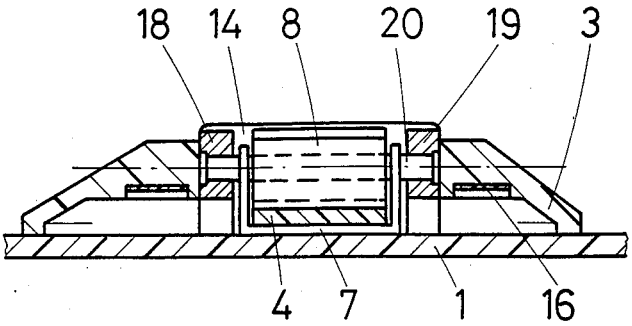
FIG. 3 is a section along the line III—III of FIG. 1.
Figure 4:
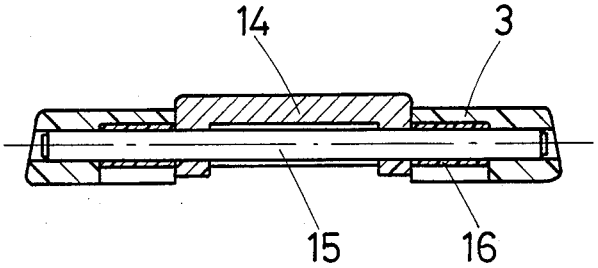

FIG. 4 section along the line IV—IV of FIG. 3.

Figure 5:
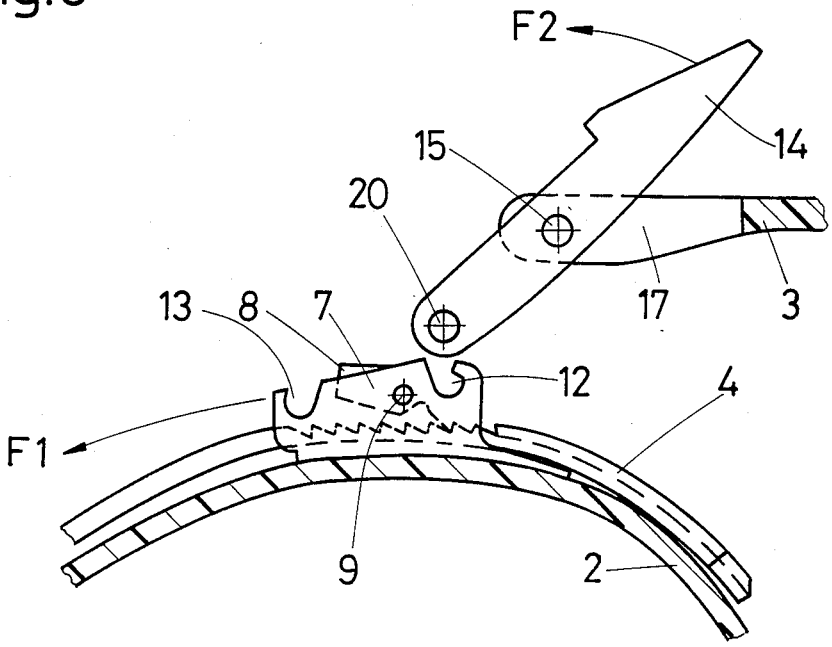

FIG. 5 the closing device just before the buckle is hooked onto the fastening member.

DESCRIPTION OF THE PREFERRED EMBODIMENT

Figure 1:
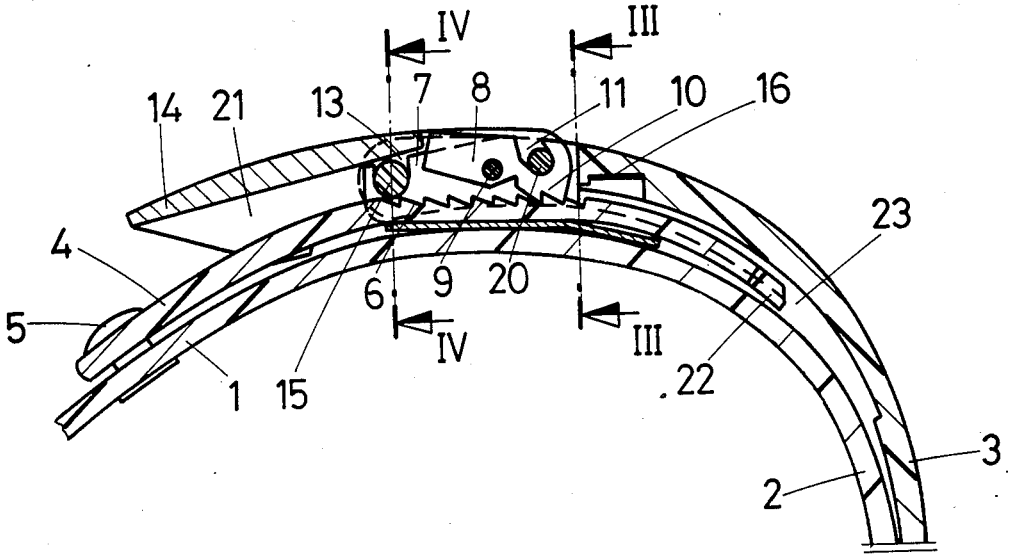
FIG. 1 is a cross-section, along the line I—I of FIG. 2, of the closing device in the closed position.
Figure 2:
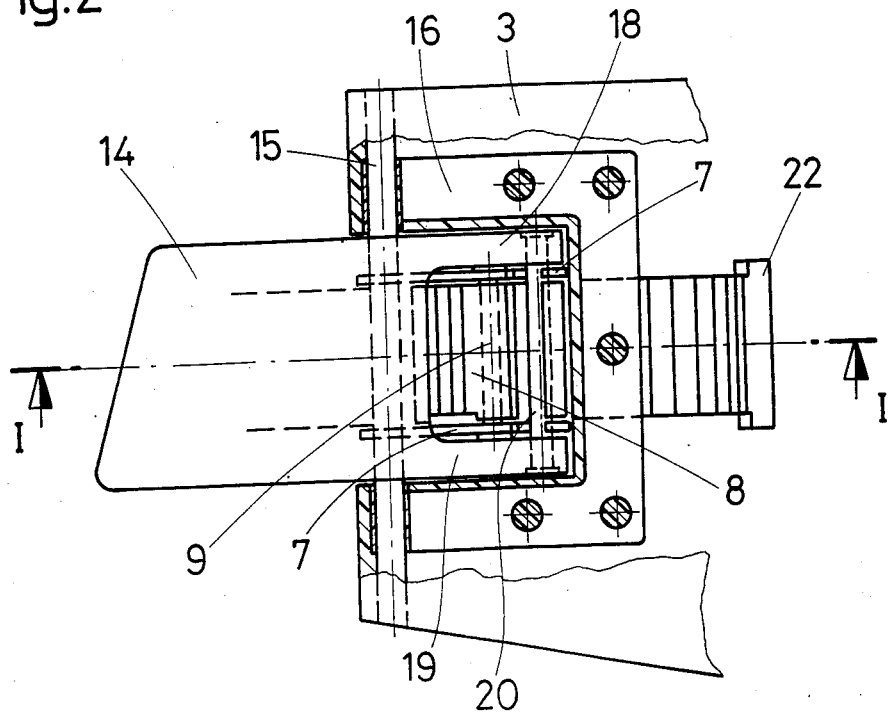
FIG. 2 is a plan view, from above, of this device.

The sectional view in FIG. 1 is a cross section through the upper of a ski boot, showing approximately the left-hand half of the left-hand boot, the front of the boot being located on the right in the drawing. This upper 1 consists of a part open at the front and having two flaps 2 and 3 which overlap at the front. A toothed strap 4 is fixed on the side and at the rear of the upper 1 by means of a rivet 5. This strap 4 is made of relatively hard synthetic material. It has saw teeth 6, i.e. teeth with an oblique flank and a flank perpendicular to the strap. A sliding block 7 in the form of a metal U-piece is mounted on and around the toothed strap 6 and has between its flanges a pawl 8 mounted on a pin 9. This pawl 8 has a double tip 10 which is kept engaged with the teeth 6 of the toothed strap by means of a torsional spring mounted around the pin 9. Above its double tip 10, the pawl has a transverse groove 11 possessing a hook-shaped profile and forming, in fact, the fastening member. The toothed strap 4 obviously passes between the bottom of the U-piece and the pawl and is clamped between these two parts.

As can be seen more clearly from FIG. 5, in which the U-piece is shown unsectioned, the flanges of this U-piece have two recesses 12 possessing a profile identical to the profile of the groove 11 and lying in the extension of this groove. The U-piece 7 has, moreover, at the other end, two rounded and aligned notches 13.

A buckle 14 is hinged with the end of the flap 3 of the upper by means of a transverse pin 15 passing approximately through the middle of the buckle and is held inside a U-shaped metal reinforcement piece 16 fixed by means of rivets to the flap 3 of the upper and surrounding a rectangular recess 17 inside which the buckle 14 is able to pivot. The buckle 14 has two arms 18 and 19 between which a small bar 20 forming the actual buckle is fixed. The other side of the buckle has a U-shaped section 21 defining the hinging pin 15 in the middle part of the buckle, such that this pin can be accommodated inside the notches 13 of the U-piece 7. Since the buckle 14 is hinged at a middle point, it acts at the same time as a tensioning lever. The toothed strap 4 has at its free end an enlarged portion 22 forming a stop for the U-piece 7. The tongue 3 of the boot has, moreover, a clearance 23 on its inner surface so as to allow the toothed strap 4 to pass through.

The closing device shown is used as follows: the buckle 14 is arranged in the position shown in FIG. 5, i.e. with its bar 20 in front of the flap 3 of the upper. The buckle 14 is then fastened to the pawl 8 by engaging its bar 20 in the groove 11 of the pawl 8, i.e. in the two recesses 12 of the U-piece 7 as well. In this engaged position, the user is able to preadjust the tightness, greater tightness being achieved by pushing the U-piece 7 in the direction of the arrow F1, together with the buckle 14. In this direction, the pawl 8 jumps over the teeth of the strap 4. In order to close and tension the closing device, it is then sufficient to pull or push the lever of the buckle 14 in the direction of the arrow F2. The buckle 14 is then pressed down ontc the toothed strap 4, its hinging pin 15 engaging inside the notches 13 of the U-piece 7, the rounded shape and radius of these notches corresponding to those of the pin 15. The buckle 14 is thus kept perfectly aligned with the U-piece 7, so that its bar 20 applies equal pressure inside the groove 11 of the pawl 8. The pulling force exerted by this bar 20 on the pawl 8 acts directly on the double pawl tip 10 and not via the pin 9 of the pawl, such that this pin is stressed only by the pivoting torque of the pawl about its double tip 10. This force is relatively small. It could be reduced even further by inclining slightly towards the rear, i.e. to the left in the drawing, the perpendicular flanks of the saw teeth. The buckle 14 is, moreover, locked against accidental opening caused by a knock or pressure on the lever arm of the buckle, as may occur in the case of certain buckles of the former type. In fact, a pressure on the lever arm of the buckle 14 tends to make the buckle pivot about its pin 15 inside the notches 13 of the U-piece. The bar 20 of the buckle is, however, still retained by the edge of the hook-shaped recesses 12 so that the buckle is locked to a certain degree in this direction.

In order to move the U-piece 7 to the right, it is sufficient to disengage the pawl 8 from the teeth 6 of the strap by pressing on the portion of the pawl located to the left of its hinging pin.

With reference to FIG. 1, it will be noted that the toothed strap 4 passes automatically underneath the flap 3 of the boot and that it is therefore hidden and protected. Furthermore, the fastening means lie mainly within the thickness of the flap 3, thereby reducing considerably the overall dimensions of the closing device.

Numerous variations of embodiment of the invention are, of course, possible. In particular, the notches 13 could be eliminated and the pin 15 could simply be positioned beyond the U-piece 7. The recesses 12 of the U-piece 7 could also be eliminated, whereby fastening must performed in particular on the pawl 8. This pawl could have a different shape, as could the buckle 14.

I claim:

1. Device for closing a first and a second part of a boot, comprising a toothed strap fixed to the first part of the boot fastening means which is mounted so as to slide on and around the toothed strap and is provided with a locking device cooperating with the toothed strap in a selected position, and a rectangular buckle which is integral with a tensioning lever hinged to the second part on the boot and which engages said fastening means, wherein the toothed strap has saw teeth, wherein said locking device comprising a a tip and a transverse groove with a hook-shaped profile located above said tip thereby engaging the saw teeth and wherein said buckle and said tensioning lever are hinged with said second part in its middle area and being pressed against said toothed strap after adjustably engaging the pawl.

2. Device for closing a first and a second part of a boot, comprising a toothed strap fixed to the first part of the boot, fastening means which is mounted so as to slide on and around the toothed strap and is provided with a locking device cooperating with the toothed strap in a selected position, a piece with a cross section of a U-shape, and a rectangular buckle which is integrated with a tensioning lever hinged to the second part of the boot and which engages said fastening means, wherein the toothed strap has saw teeth, wherein said locking device comprises a pawl having a tip and a transverse groove with a hook-shaped profile located above said tip thereby engaging the saw teeth, wherein said buckle and said tensioning lever are hinged with said second part and being pressed against said toothed strap after adjustably engaging the pawl, and wherein said U-shaped piece engages said toothed strap and has a proximal end, a middle portion, and a distal end, said proximal end having a recess with a cross section substantially matching a profile of said transverse groove and aligned so as to form an extension of said transverse groove, said pawl being hinged about said middle portion, said distal end having a notch adapted to receive a pin of said buckle when said buckle is pressed against said strap, said recess having a detent profile which prevents said buckle from pivoting within said notches thereby preventing said buckle from inadvertently releasing.

* * * * *